US006824259B2

(12) United States Patent
Liu

(10) Patent No.: US 6,824,259 B2
(45) Date of Patent: Nov. 30, 2004

(54) INK CARTRIDGE OF INK-JET PRINTER

(76) Inventor: Yuan-Yuan Liu, 235 Chung-Ho Box 8-24, Taipei (TW)

( * ) Notice: Subject to any disclaimer, the term of this patent is extended or adjusted under 35 U.S.C. 154(b) by 15 days.

(21) Appl. No.: 10/174,831

(22) Filed: Jun. 20, 2002

(65) Prior Publication Data

US 2003/0234843 A1 Dec. 25, 2003

(51) Int. Cl.[7] ..... B41J 2/175
(52) U.S. Cl. ..... 347/86; 347/87
(58) Field of Search ..... 347/87–92

(56) References Cited

U.S. PATENT DOCUMENTS 6,302,534 B1 * 10/2001 Tsukahara et al. ..... 347/86
6,454,399 B2 * 9/2002 Ujita et al. ..... 347/86
6,490,792 B1 * 12/2002 Ishinaga et al. ..... 29/890.1

* cited by examiner

*Primary Examiner*—Stephen D. Meler
*Assistant Examiner*—Ly T Tran

(57) ABSTRACT

An ink cartridge of an inkjet printer is formed by an ink box, and an ink box cover. A connection portion thereof is formed with a tilt stepped surface. A top of the ink box cover is formed with a liquid filling hole and an air inlet. The liquid filling hole is at the same side of the output port of the ink box and the air inlet is at an opposite side of the output port. A plurality of posts are installed in the ink box cover. Thereby, after the ink box is melted-connected to the ink box cover, the posts extrudes the filling material therein to form an air flow path. Thereby, the ink in the ink box is supplemented from the farmost end so as to avoid that ink in one side is exhausted, while the ink in another side can not supplement to the output port.

4 Claims, 5 Drawing Sheets

INK CARTRIDGE OF INK-JET PRINTER

FIELD OF THE INVENTION

The present invention relates to ink cartridges; and particularly to an ink cartridge of an inkjet printer, wherein ink in the ink box is supplemented from the farmost end so as to avoid that ink in one side is exhausted, while the ink in another side can not supplement to the output port.

DESCRIPTION OF THE RELATED ART

The prior art ink cartridge of an ink-jet printer is illustrated in FIG. 1, which is formed by an ink box 1B and an ink box cover 2B at the top surface of the ink box 1B. The interior of the ink box 1 has a receiving chamber 12 for receiving ink. Filling material A is filled in the receiving chamber 12. A bottom of the ink box 1B has an output port. A plurality of air channels are formed at the top end of the ink box cover 2B. The air channels 26 are exactly communicated to the liquid filling hole 27. The liquid filling hole 27 is at the same side of the output port 13. When the ink flows out from the output port 13, since the liquid filling hole 27 is at the same side of the output port 13, the air flow only flows at the side of the output port 13 of the ink box. Thereby, the ink can not be supplemented to another end in the ink box 1B quickly. Thus, the ink can not flow out easily (since one side has a large flow, while the supplement speed is slow), even ink in one side of the ink box 1B is exhausted, while the ink at another side can not supply to this side successfully.

SUMMARY OF THE INVENTION

To achieve above objects, the present invention provides an ink cartridge of an ink-jet printer comprising an ink box, and an ink box cover connected to the ink box. The ink box has at least one receiving chamber for receiving filling material; and a bottom of each receiving chamber being communicated to an output port; a lower edge of the output port is adhered with a plug having a via hole and a draining preventing film for preventing ink from flowing out.

The ink box and an ink box cover are melted-connected through vibration and friction. A top of the ink box cover is installed with a liquid filling hole, and an air inlet. The liquid filling hole is at the same side of the output port of the ink box and the air inlet is at an opposite side of the output port of the ink box. A part of the liquid filling hole is protruded from an inner surface of the ink box cover have notches. Thereby, air may flow through the notches. Upper sides of the liquid filling hole and the air inlet are covered by a film layer by thermally melting. A tearing track is formed on the film between the liquid filling hole and the air inlet. A plurality of posts are installed in the ink box cover. Thereby, after the ink box is melted-connected to the ink box cover, the posts extrudes the filling material therein so as to form an air flow path.

When the ink is absorbed from the output port, the ink in the air inlet will be absorbed to the output port in advance and then flows out from the output port so that the ink in the air inlet flows to the output end successfully and thus. The ink in the ink box is supplemented from a farmost end so as to avoid that when ink in one side of the ink box is exhausted, the ink in another side can not supplement to the output port.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1A:
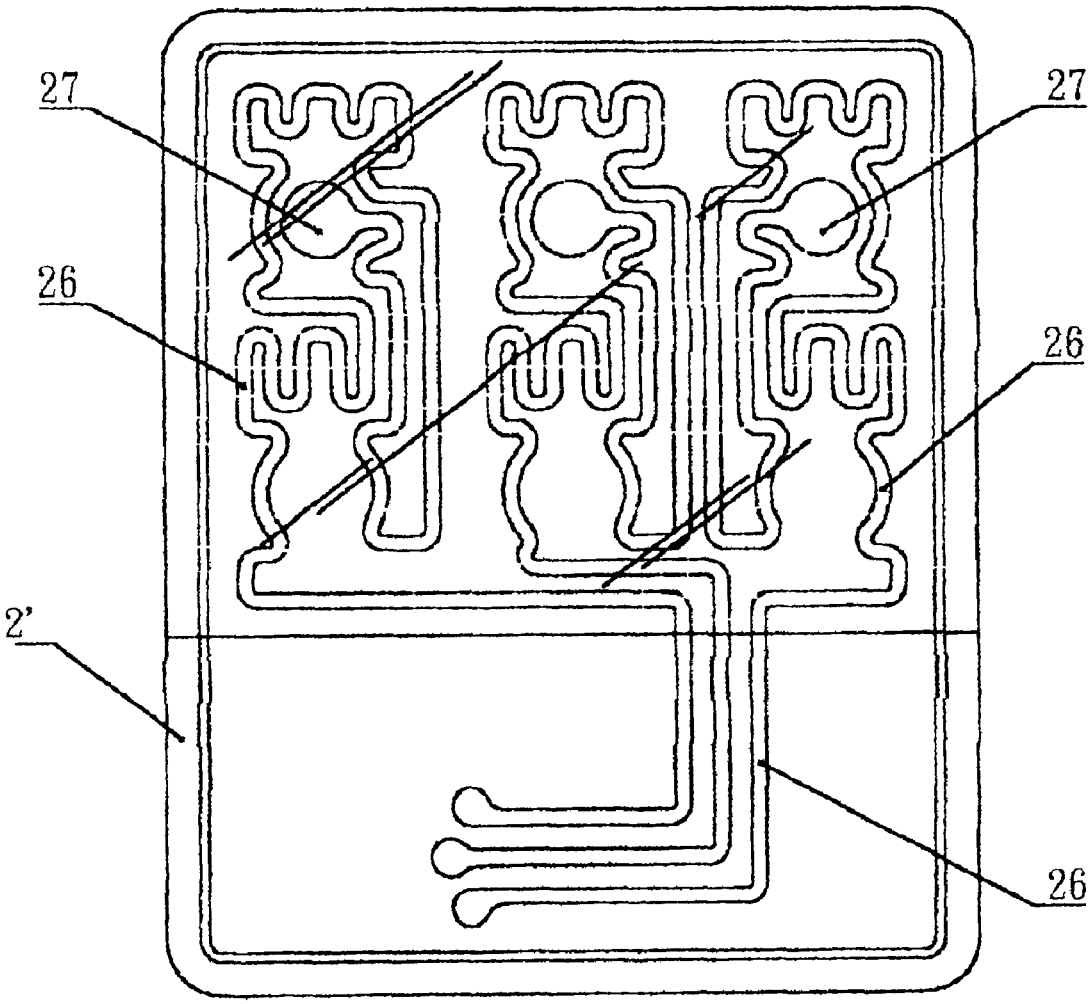
FIG. 1A PRIOR ART
FIG. 1A is an elevational view of the prior art.
Figure 1B:
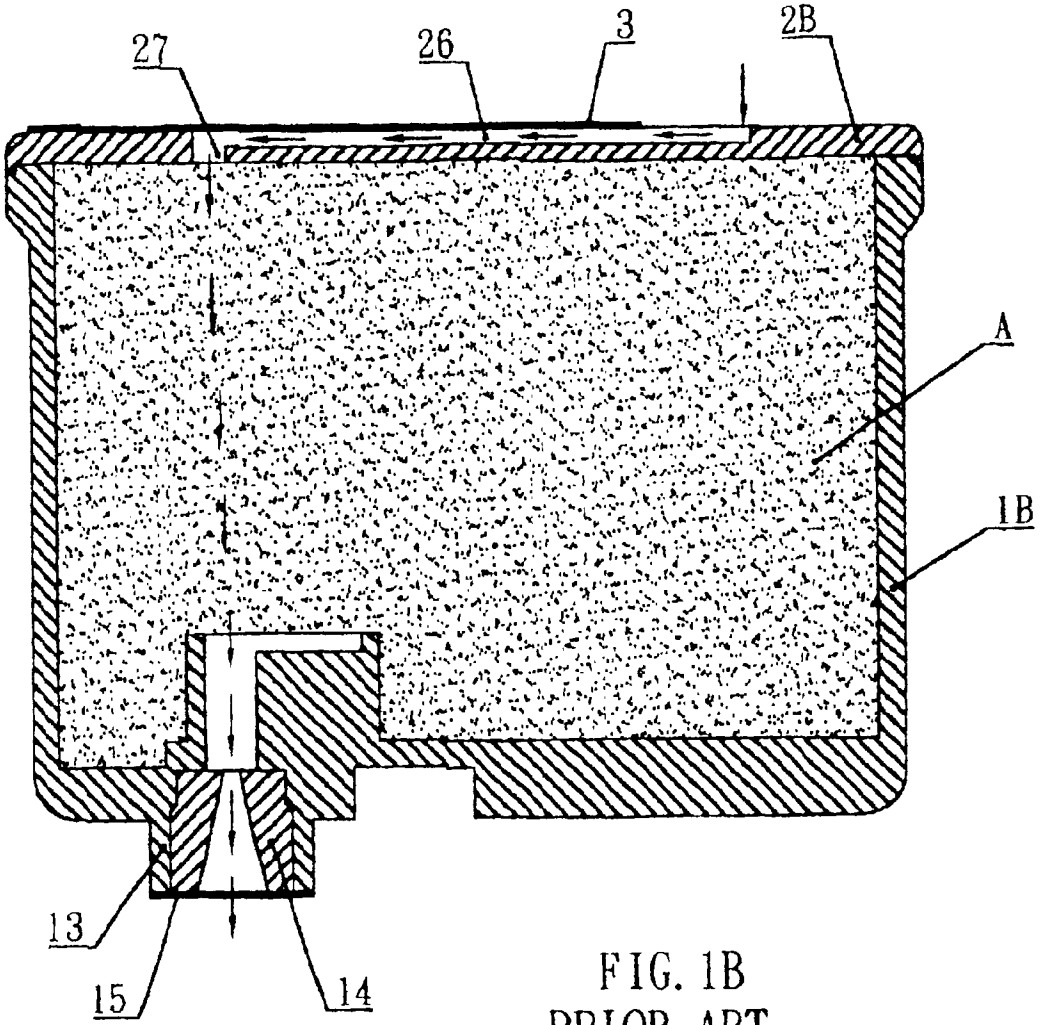
FIG. 1B PRIOR ART
FIG. 1B is a plane cross sectional view of the prior art.
Figure 2:
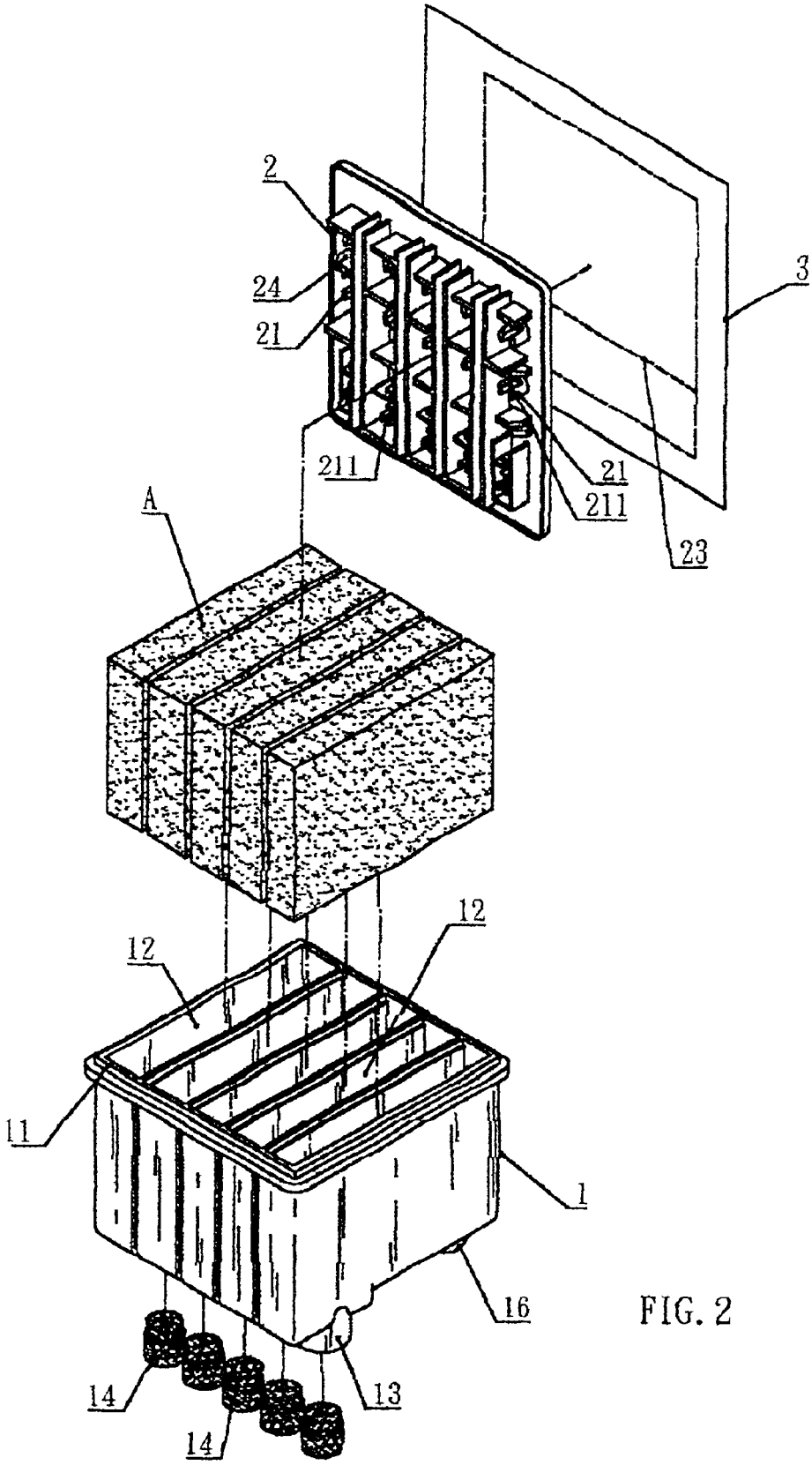
FIG. 2 is an exploded perspective view of the present invention.
Figure 3:
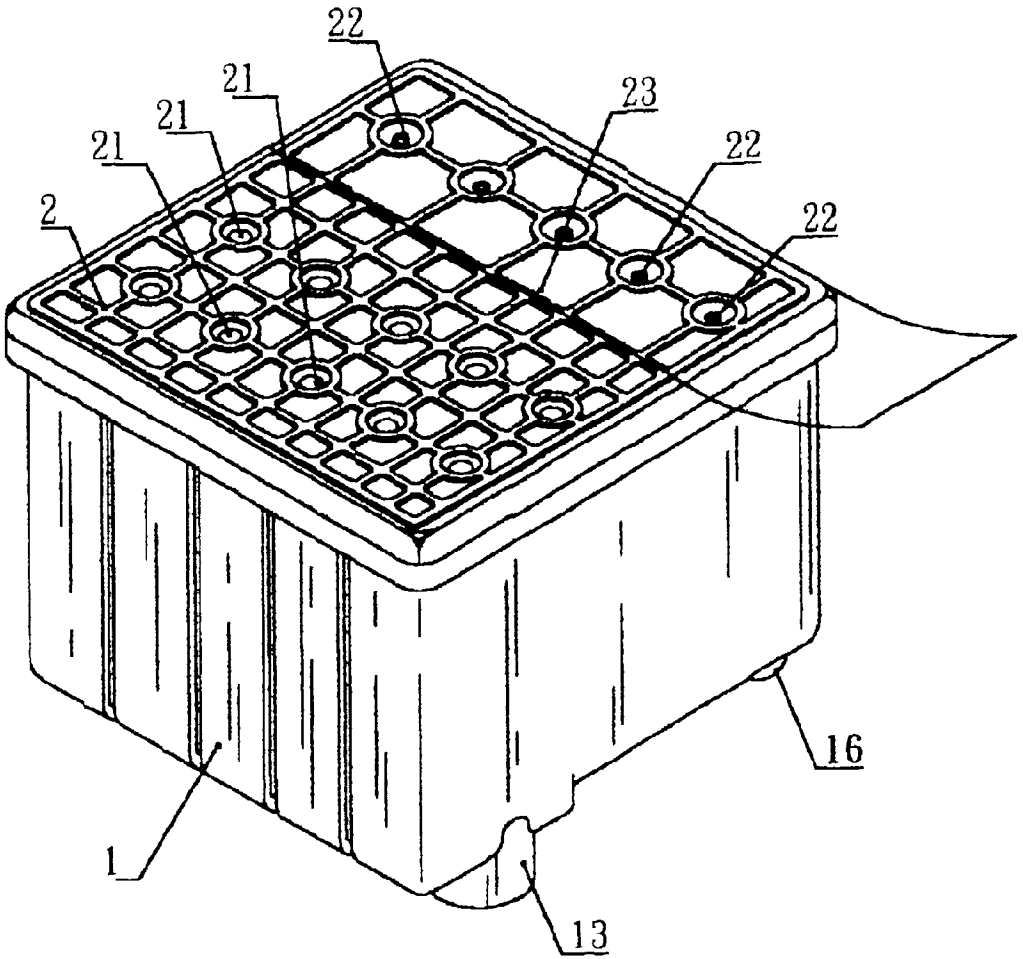
FIG. 3 is an assembled perspective view of the present invention.

Referring to FIGS. 2 and 3, the structure of the present invention is illustrated. The present invention is formed by an ink box 1, and an ink box cover 2 connected to the ink box 1 by melting-connection through vibration and friction. The ink box 1 and the ink box cover 2 are made of polypropylene.

The melting connection portion of the ink box 1 and the ink box cover 2 is formed with a tilt stepped surface 11. An interior of the ink box 1 has at least one receiving chamber 12 with filling material A therein. A bottom of each receiving chamber 12 is communicated to the output port 13 of the ink box 1. The lower edge of the output port 13 has a rubber plug 14 with via hole and a draining preventing film 15 for preventing ink to flow out. Two sides of the draining preventing film 15 have notches 151 for releasing air so that the film will not expand outwards.

An end of a bottom of the ink box 1 opposite to the output port 13 has noses of different sizes according to the ink jet printer so that when the ink box 1 moves reciprocally, it is in a horizontal status.

Figure 4A:
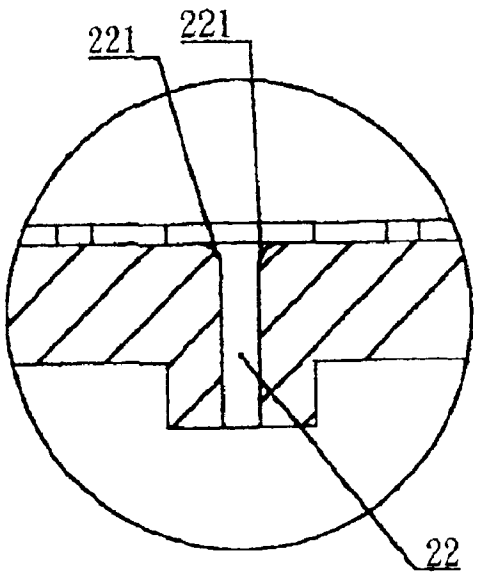
FIG. 4A is an enlarge schematic view of the air inlet of the present invention.
Figure 4:
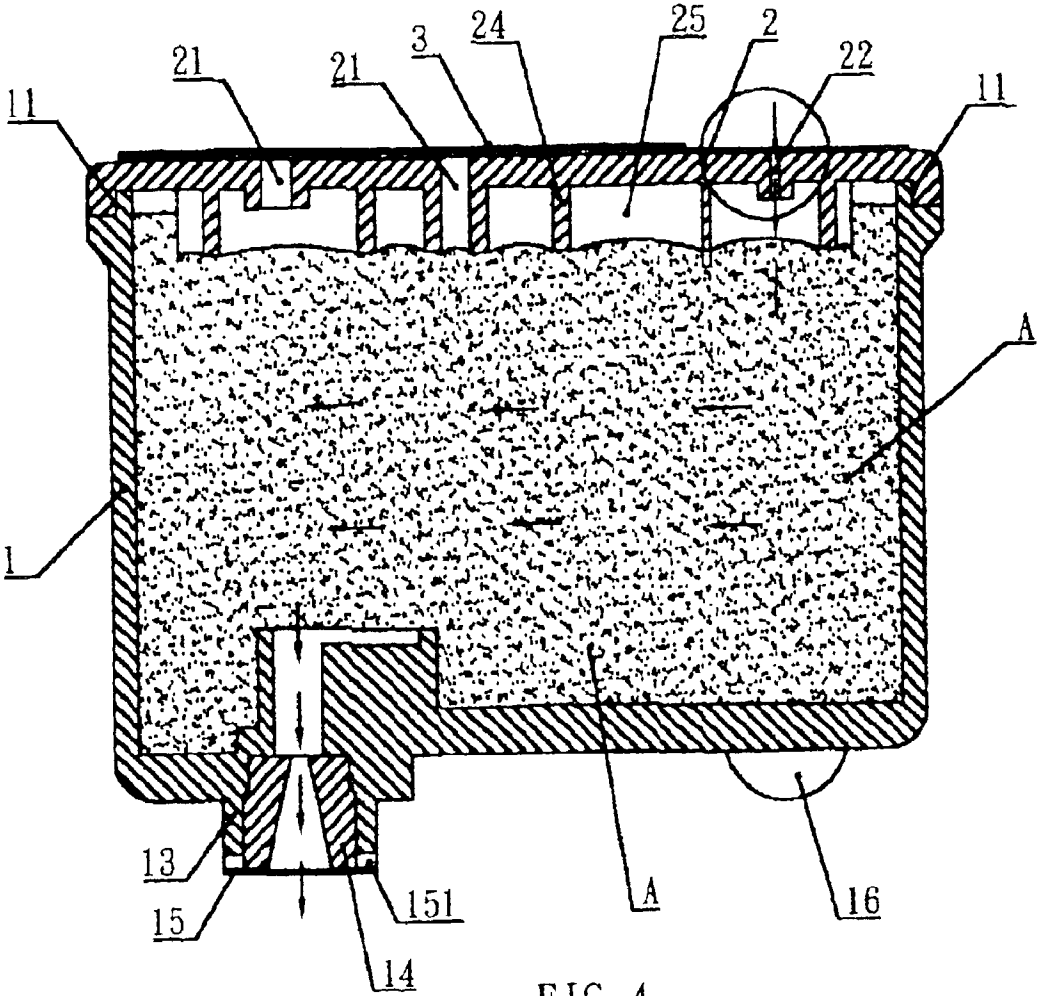
FIG. 4 is a plane cross sectional view showing the operation of the present invention.

Referring to FIGS. 3, 4 and 4A, a top of the ink box cover 2 is installed with a liquid filling hole 21, and an air inlet 22. The liquid filling hole 21 is at the same side of the output port 13 of the ink box 1 and the air inlet 22 is at an opposite side of the output port 13 of the ink box 1. The upper sides of the liquid filling hole 21 and the air inlet 22 are covered by a film layer 3 by thermally melting. A tearing track is formed on the film 3 between the liquid filling hole 21 and the air inlet 22.

Moreover, the liquid filling hole 21 and the film 3 are melt-connected tightly so that the film 3 is completely melt upon the upper side of the liquid filling hole 21 so as to prevent the film 3 upon the liquid filling hole 21 from falling out. A part of the liquid filling hole 21 protruded from the inner surface of the ink box cover 2 have notches 211. Thereby, air may flow through the notches 211. The melting connection portion of the air inlet 22 and the film 3 has an opening 221 with round corners (referring to FIG. 4A) so that the air inlet 22 and the film 3 can be connected tightly.

Therefore, when the user tears the film 3 from the tearing track. The air inlet 22 may increase the diameter by the round opening 221 so that it will not be torn out with the film 3. Thereby, the air inlet 22 can be exposed completely. This is helpful about the flowing of the ink.

A plurality of posts 24 are installed in the ink box cover 2. Thereby, after the ink box 1 is melted-connected to the ink box cover 2, the posts 24 may extrude the filling material herein so as to form an air flow path 25.

Referring to FIG. 4, liquid filling hole 21 at the top of the ink box 1 is at the same side with the output part 13 and the air inlet 22 is at another side of the top of the ink box cover 2. After the film 3 is torn down, air will flow into the ink box 1 from the air inlet 22

The interior of the ink box cover 2 has posts 24. After the ink box 1 and ink box cover 2 are connected by melting, the posts 24 will protrude the filling material A to generate air flow channel in the ink box cover 2. Thereby, when the ink is absorbed from the output port 13, the ink in the air inlet 22 will be absorbed to the output port 13 in advance and then flows out from the output port 13 so that the ink in the air inlet flows to the output end successfully. Thereby, the ink in the ink box 1 is supplemented from the farmost end to avoid that when ink in one side of the ink box 1 exhausts, ink in another side can not supplement to the output port.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An ink cartridge of an ink-jet printer comprising an ink box, and an ink box cover connected to the ink box; the ink box having at least one receiving chamber for receiving tilling material; and a bottom of the at least one receiving chamber being communicated to an output port; a lower edge of the output port is adhered with a plug having a via hole and a draining preventing film for preventing ink from flowing out; characterized in that:

the ink box and an ink box cover are melted-connected through vibration and friction; a top of the ink box cover is installed with a liquid filling hole, and an air inlet; the liquid filling hole is at the same side of the output port of the ink box and the air inlet is at an opposite side of the output port of the ink box; a part of the liquid filling hole protruded from an inner surface of the ink box cover has notches; thereby, air flows through the notches; upper sides of the liquid filling hole and the air inlet are covered by a film layer by thermally melting; a plurality of posts are formed in the ink box cover; thereby, after the ink box is melted-connected to the ink box cover, the posts extrudes the filling material therein so as to form an air flow path;

when the ink is absorbed from the output port, the ink in the air inlet will be absorbed to the output port in advance and then flows out from the output port so that the ink in the air inlet flows to the output end successfully and thus, the ink in the ink box is supplemented from an farmost end; and wherein, the two sides of each output port near the draining preventing film have respective notches and the notches serve for venting air.

2. The ink cartridge of an ink-jet printer as claimed in claim 1, wherein the ink box and the ink box cover are made of polypropylene; and a connection portion of the ink box and the ink box cover is installed with a tilt stepped surface.

3. The ink cartridge of an ink-jet printer as claimed in claim 1, wherein an end of a bottom of the ink box opposite to the output port has noses of different sizes according to the ink jet printer so that when the ink box moves reciprocally, it is in a horizontal status.

4. The ink, cartridge of an ink-jet printer as claimed in claim 1, wherein the melting connection portion of the air inlet and the film is an opening with round corners so that the air inlet and the film are connected tightly; therefore, when the user tears the film; the air inlet has an increased diameter by the round opening so that it will not be torn out with the film; thereby, the air inlet is exposed completely.

* * * * *